US008448576B2

(12) United States Patent
Theurer et al.

(10) Patent No.: US 8,448,576 B2
(45) Date of Patent: May 28, 2013

(54) TAMPING MACHINE

(75) Inventors: Josef Theurer, Vienna (AT); Erwin Matzinger, Linz (AT)

(73) Assignee: Franz Plasser Bahnbaumaschinen-Industriegesellschaft m.b.H, Vienna (AT)

( * ) Notice: Subject to any disclaimer, the term of this patent is extended or adjusted under 35 U.S.C. 154(b) by 280 days.

(21) Appl. No.: 12/736,579

(22) PCT Filed: Apr. 3, 2009

(86) PCT No.: PCT/EP2009/002447

§ 371 (c)(1),
(2), (4) Date: Oct. 20, 2010

(87) PCT Pub. No.: WO2009/132746

PCT Pub. Date: Nov. 5, 2009

(65) Prior Publication Data

US 2011/0030573 A1 Feb. 10, 2011

(30) Foreign Application Priority Data

Apr. 28, 2008 (AT) ..... 657/2008

(51) Int. Cl.
*E01B 27/16* (2006.01)

(52) U.S. Cl.
CPC ..... *E01B 27/16* (2013.01)
USPC ..... 104/12

(58) Field of Classification Search
CPC ..... E01B 27/16
USPC ..... 104/2, 10, 12
IPC ..... E01B 27/16
See application file for complete search history.

(56) References Cited

U.S. PATENT DOCUMENTS

| | | | | |
|---|---|---|---|---|
| 5,007,349 | A | 4/1991 | Theurer | |
| 5,007,350 | A | 4/1991 | Theurer | |
| 5,127,334 | A * | 7/1992 | Theurer | 104/12 |
| 5,269,226 | A * | 12/1993 | Theurer et al. | 104/12 |

FOREIGN PATENT DOCUMENTS

| | | |
|---|---|---|
| CA | 2 090 396 | 10/1993 |
| EP | 0 386 398 | 9/1990 |
| EP | 0 455 179 | 11/1991 |
| EP | 0 564 433 | 10/1993 |

OTHER PUBLICATIONS

International Search Report, Apr. 2009.

* cited by examiner

*Primary Examiner* — Mark Le
(74) *Attorney, Agent, or Firm* — Collard & Roe, P.C.

(57) ABSTRACT

A tamping machine designed especially for tamping switch sections comprises two inner and two outer tamping units (13, 24). Each outer tamping unit (24) is designed to be pivotable about a pivot axis (26), extending in the longitudinal direction of the machine, relative to a guide block (25) connected for displacement to transverse guides (12) and to a transverse displacement drive (14), and is connected to a pivot drive (27). Thus, tamping tools (18) of the outer tamping unit (24) can be positioned at a maximum distance from a machine center (23) for extensive tamping of a branch rail.

8 Claims, 2 Drawing Sheets

Fig.1
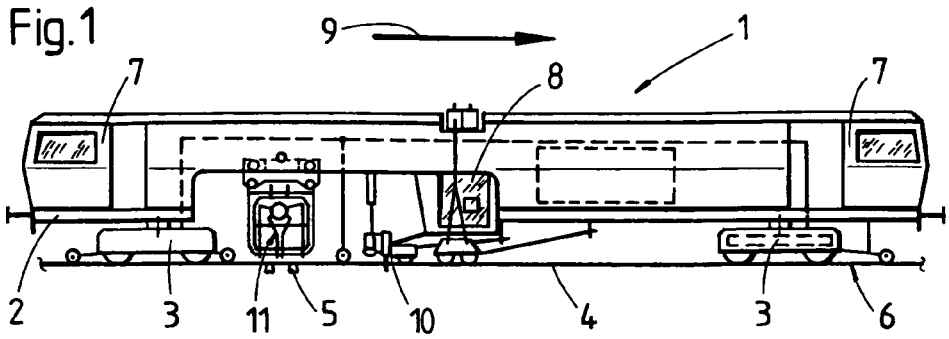
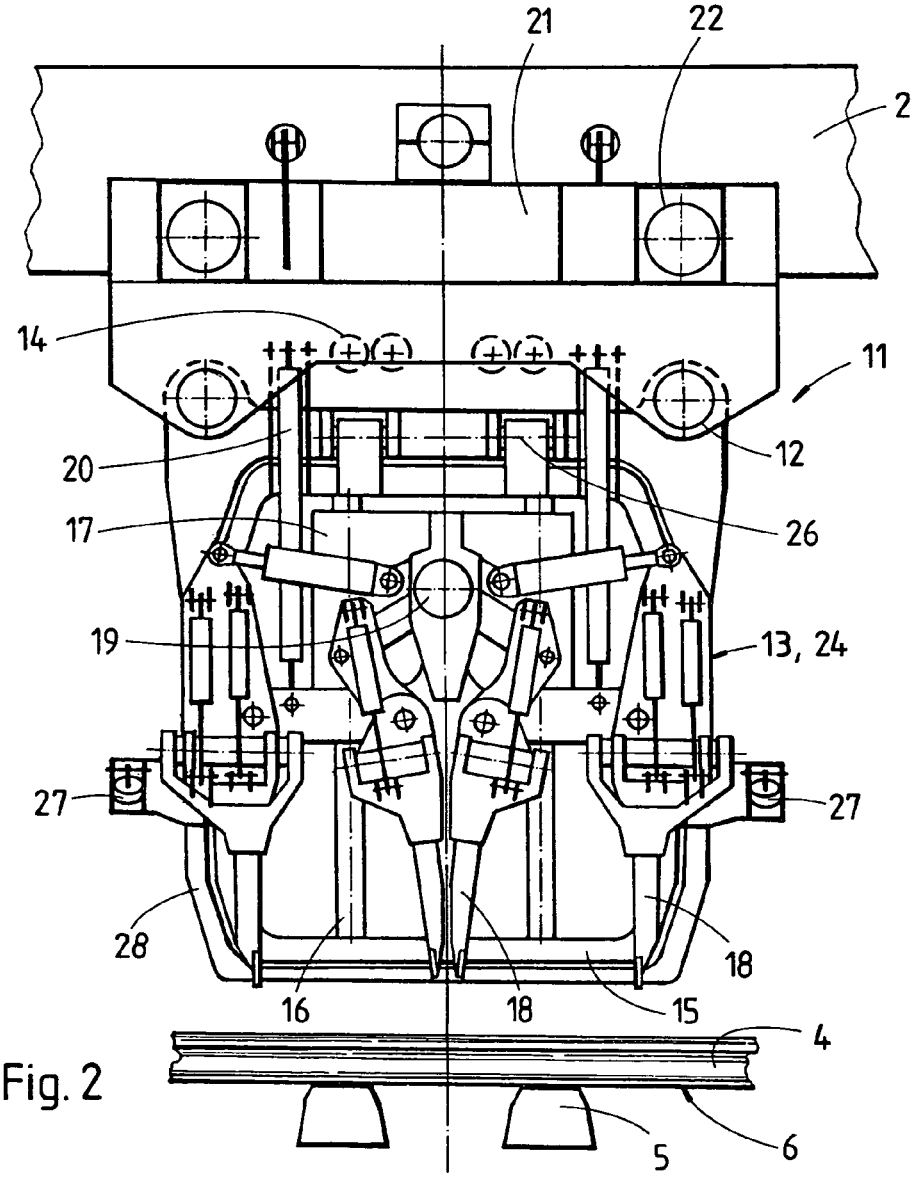
Fig. 2

TAMPING MACHINE

CROSS REFERENCE TO RELATED APPLICATIONS

This application is the National Stage of PCT/EP2009/002447 filed on Apr. 3, 2009, which claims priority under 35 U.S.C. §119 of Austrian Application No. A 657/2008 filed on Apr. 28, 2008, the disclosure of which is incorporated by reference. The international application under PCT article 21(2) was not published in English.

BACKGROUND

The invention relates to a tamping machine.

A tamping machine of this type, having a total of four tamping units which are transversely pivotable independently of one another, is known from U.S. Pat. No. 5,007,350.

According to EP 0 455 179 B1, it is also known that each outer tamping unit is supported on the adjacent inner tamping unit for transverse pivoting in order to be able, in a switch section, to also tamp a part of a branch rail.

SUMMARY

It is the object of the present invention to create a tamping machine of the type mentioned at the beginning, the outer tamping units of which may be moved even further away from the machine center.

According to the invention, this object is achieved which a tamping machine of the specified kind in that each outer tamping unit is designed to be pivotable about a pivot axis, extending in the longitudinal direction of the machine, relative to a guide block connected for displacement to the transverse guides and to the respective transverse displacement drive, and is connected to a pivot drive.

With this configuration, each outer tamping unit in an advantageous way is transversely pivotable in addition to being transversely displaceable. Thus, it is possible to tamp branch track sections of a switch to an even greater extent concurrently with the tamping of the straight track section. It is also particularly advantageous that no retooling operations are required for the additional transverse pivoting.

Additional advantages of the invention become apparent from the dependent claims and the drawing description.

The invention will be described in more detail below with reference to an embodiment represented in the drawing in which

BRIEF DESCRIPTION OF THE DRAWINGS

FIG. 1 shows a simplified side view of a tamping machine,

FIG. 2 shows an enlarged side view of a tamping assembly,

DETAILED DESCRIPTION

Figure 3:
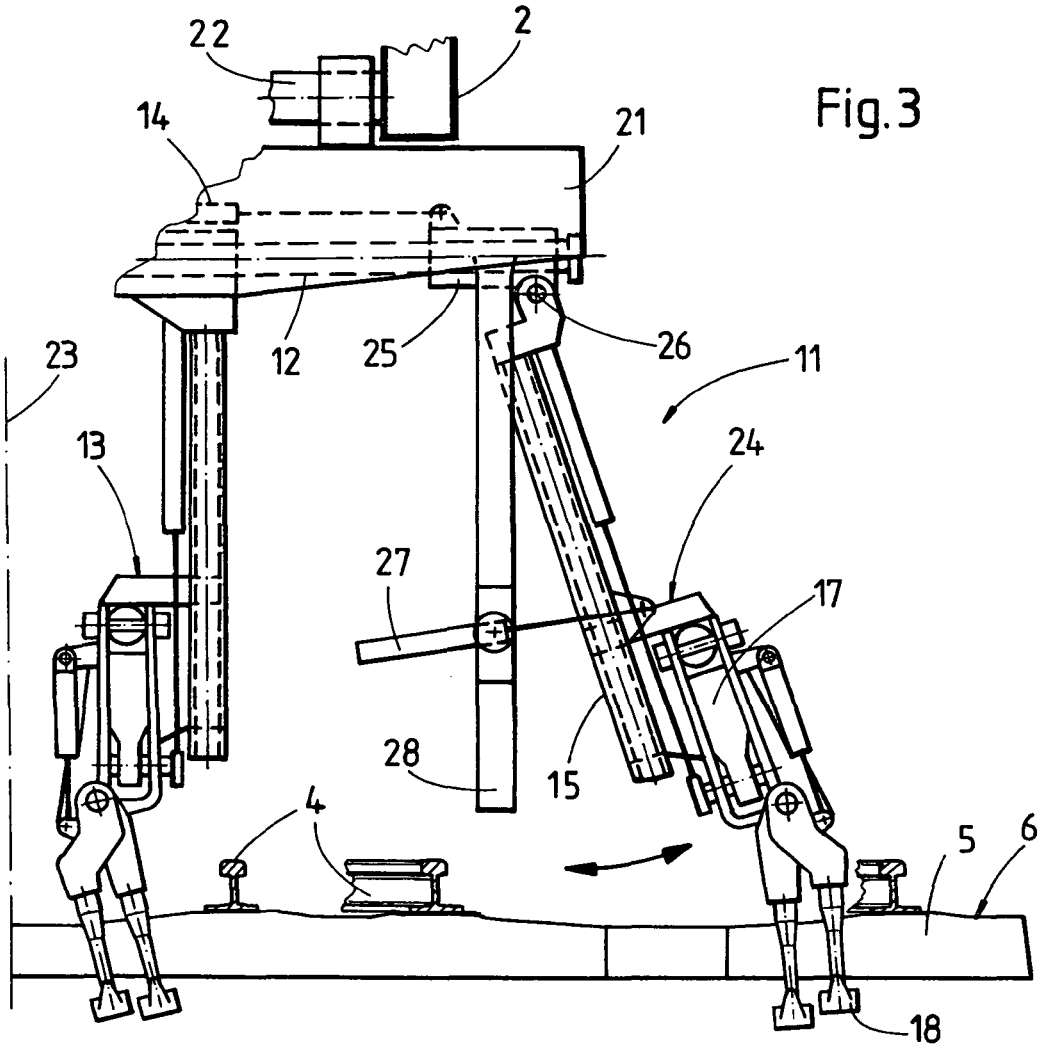
FIG. 3 shows a view, in the longitudinal direction of the machine, of a part of the tamping assembly.

A tamping machine 1, shown in FIG. 1, has a machine frame 2 which is mobile via on-track undercarriages 3 on a track 6 formed of rails 4 and sleepers 5. Driver's cabins 7, arranged at the ends, as well as a work cabin 8 are provided for accommodating the operating personnel during the transfer travel and working advance in the working direction indicated by an arrow 9. Arranged between the on-track undercarriages

3 are a track lifting and lining unit 10 and, following the latter in the working direction, a tamping assembly 11. A levelling and lining reference system is provided for correction of the track position.

As can be seen in FIGS. 2 and 3, the tamping assembly 11—designed especially for tamping switch sections—consists of tamping units 13, 24 mounted on transverse guides 12 for displacement independently of one another in a direction extending perpendicularly to the longitudinal direction of the machine. For the purpose of said transverse displacement, each tamping unit 13, 24 is connected to a transverse displacement drive 14 supported on the machine frame 2.

Each tamping unit 13, 24 comprises an assembly frame 15, having two vertical guides 16, and a tool carrier 17 vertically adjustable along the latter. Said tool carrier 17 is equipped with squeezable tamping tools 18 and a vibration drive 19 and is vertically adjustable relative to the assembly frame 15 by means of a drive 20. An assembly carrier 21 connected to the transverse guides 12 is transversely displaceable on guides 22 extending perpendicularly to the longitudinal direction of the machine.

In FIG. 3, a machine center or track center 23 is indicated by a dash-and-dot line. For the sake of simplicity, only one half of a tamping assembly 11 is shown. Said half is composed in each case of an inner tamping unit 13, adjoining the machine center 23, and an outer tamping unit 24 which is distanced farther from the machine center 23.

Each outer tamping unit 24 is designed to be pivotable about a pivot axis 26, extending in the longitudinal direction of the machine, relative to a guide block 25 connected for displacement to the transverse guides 12 and to the respective transverse displacement drive 14. To that end, a pivot drive 27 is connected, on the one hand, to the assembly frame 15 and, on the other hand, to a support frame 28 which is positioned in a vertical plane and in a plane extending in the longitudinal direction of the machine and is connected to the guide block 25.

As illustrated in FIG. 3, the outer tamping unit 24 together with the assembly frame 15, the tool carrier 17 and the tamping tools 18 are situated in an outermost pivot position. In said position, the tamping tools 18 are maximally distanced from the machine center or track center 23.

In a base position of the outer tamping unit 24, the assembly frame 15 is situated in a common plane with the support frame 28. In this position, the latter surrounds the assembly frame 15, as visible in FIG. 2. Between the base position and the outermost pivot position, any required intermediate position is possible, as desired, wherein an unimpeded lowering of the tamping tools 18 for ballast consolidation is possible in each case.

Figure 4:
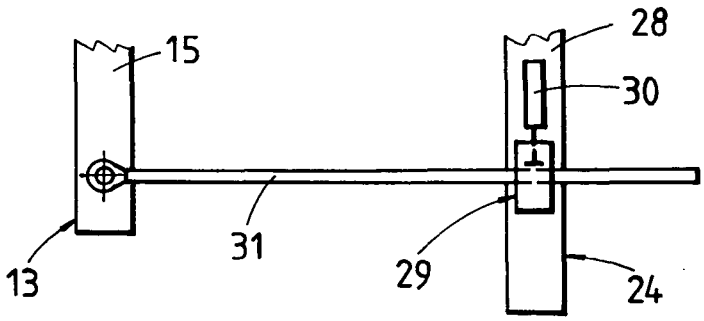
FIG. 4 shows a simplified representation of a clamping device.

As shown in FIG. 4 in a schematic and simplified manner, a clamping device 29 having a clamping drive 30 may be provided between the assembly frame 15 of the inner tamping unit 13 and the support frame 28 of the outer tamping unit 24. A stabilising rod 31 designed to be fixated by the clamping drive 30 is pivotably connected to the adjacent assembly frame 15. Thus, the support frame 28 of the outer tamping unit 24 can be stabilised. When Carrying out a transverse displacement of the tamping unit 24 with activation of the transverse displacement drive 14, the clamping drive 30 is automatically actuated to release the clamping action.

As an alternative to the pivot drive 27 shown in FIGS. 2 and 3, it would also be possible to arrange said pivot drive as a rotary drive directly in the pivot axis 26. In this case, no support frame 28 would be required.

The invention claimed is:

1. A tamping machine for tracks comprising:

a plurality of tamping units comprising: at least two inner tamping units adjacent to one another with respect to a transverse direction of the track or machine, and at least two outer tamping units adjoining said inner tamping units;

a plurality of transverse guides;

a plurality of transverse displacement drives;

a plurality of tamping tools;

a plurality of tool carriers;

a plurality of assembly frames;

a plurality of guides;

a plurality of guide blocks;

a plurality of pivot drives;

a plurality of support frames;

wherein said plurality of tamping units are transversely displaceable independently of one another on said plurality of transverse guides by means of said plurality of transverse displacement drives and are equipped with said plurality of tamping tools which are supported on said tool carriers vertically adjustably connected to said assembly frames via said plurality of guides, wherein each outer tamping unit is designed to be pivotable about a pivot axis, extending in a longitudinal direction of the machine, relative to a respective one of said guide blocks connected for displacement to said plurality of transverse guides and to a respective one of said transverse displacement drives, and is connected to a respective one of said pivot drives;

wherein said assembly frames of said at least two outer tamping units are mounted for pivoting on respective ones said support frames, wherein said support frames are connected to respective ones of said guide blocks, and wherein said pivot drives are articulately connected to said support frames and to said assembly frames of said outer tamping units.

2. A tamping machine according to claim 1, wherein said support frame and said assembly frame of each one of the outer tamping units in their base position are situated in a common plane extending in the longitudinal direction of the machine, wherein said assembly frame is surrounded by said support frame.

3. A tamping machine according to claim 1, further comprising a selectively releasable clamping device and a stabilizing rod, said selectively releasable clamping device configured for fixing said stabilizing rod, which is connected to the assembly frame of one of the inner tamping units.

4. A tamping machine comprising:

a plurality of tamping units comprising: at least two inner tamping units adjacent to one another with respect to a transverse direction of the track or machine, and at least two outer tamping units adjoining said inner tamping units;

a plurality of transverse guides;

a plurality of transverse displacement drives;

a plurality of tamping tools;

a plurality of tool carriers;

a plurality of assembly frames;

a plurality of guides;

a plurality of guide blocks;

a plurality of pivot drives;

a plurality of support frames;

wherein said plurality of tamping units are transversely displaceable independently of one another on said transverse guides by means of said transverse displacement drives and are equipped with said plurality of tamping tools which are supported on said tool carriers vertically adjustably connected to said assembly frames via said plurality of guides, wherein each outer tamping unit is designed to be pivotable about a pivot axis, extending in a longitudinal direction of the machine, relative to one of said guide blocks connected for displacement to said plurality of transverse guides and to a respective one of said transverse displacement drives, and is connected to a respective one of said pivot drives;

wherein said assembly frames of said at least two outer tamping units are mounted for pivoting on respective ones of said guide blocks, wherein said support frames are connected to said guide blocks and wherein said pivot drives are articulately connected to said support frames and to said assembly frames of said outer tamping units.

5. A tamping machine according to claim 4, wherein said support frame and said assembly frame of each said outer tamping units in their base position are situated in a common plane extending in the longitudinal direction of the machine, wherein said assembly frame is surrounded by said support frame.

6. A tamping machine according to claim 4, further comprising a selectively releasable clamping device and a stabilizing rod, said selectively releasable clamping device configured for fixing said stabilizing rod, which is connected to the assembly frame of one of the inner tamping units.

7. A tamping machine comprising:

a plurality of tamping units comprising: at least two inner tamping units adjacent to one another with respect to a transverse direction of the track or machine, and at least two outer tamping units adjoining said inner tamping units;

a plurality of transverse guides;

a plurality of transverse displacement drives;

a plurality of tamping tools;

a plurality of tool carriers;

a plurality of assembly frames;

a plurality of guides;

a plurality of guide blocks;

a plurality of pivot drives;

a plurality of support frames;

wherein said plurality of tamping units are transversely displaceable independently of one another on said transverse guides by means of said transverse displacement drives and are equipped with said plurality of tamping tools which are supported on said tool carriers vertically adjustably connected to said assembly frames via said plurality of guides, wherein each outer tamping unit is designed to be pivotable about a pivot axis, extending in a longitudinal direction of the machine, relative to a respective one of said guide blocks connected for displacement to said plurality of transverse guides and to a respective one of said transverse displacement drives, and is connected to a respective one of said pivot drives;

wherein said support frame and said assembly frame of each said outer tamping units in their base position are situated in a common plane extending in the longitudinal direction of the machine, wherein said assembly frame is surrounded by said support frame.

8. A tamping machine comprising:

a plurality of tamping units comprising: at least two inner tamping units adjacent to one another with respect to a transverse direction of the track or machine, and at least two outer tamping units adjoining said inner tamping units;

a plurality of transverse guides;
a plurality of transverse displacement drives;
a plurality of tamping tools;
a plurality of tool carriers;
a plurality of assembly frames;
a plurality of guides;
a plurality of guide blocks;
a plurality of pivot drives;
a plurality of support frames;
wherein said plurality of tamping units are transversely displaceable independently of one another on said transverse guides by means of said transverse displacement drives and are equipped with said plurality of tamping tools which are supported on said tool carriers vertically adjustably connected to said assembly frames via said plurality of guides, wherein each outer tamping unit is designed to be pivotable about a pivot axis, extending in a longitudinal direction of the machine, relative to a respective one of said guide blocks connected for displacement to said plurality of transverse guides and to a respective one of said transverse displacement drives, and is connected to a respective one of said pivot drives;
a selectively releasable clamping device; and
a stabilizing rod connected to a corresponding one of the assembly frames of each of said at least two inner tamping units, and said selectively releasable clamping device provided on one of said support frames and configured for fixing said stabilizing rod.

* * * * *